US007307641B2

(12) United States Patent
Dowdy

(10) Patent No.: US 7,307,641 B2
(45) **Date of Patent: *Dec. 11, 2007**

(54) METHOD AND APPARATUS FOR TRANSFORMING DISPLAY DATA USING MULTIPLE FRAME BUFFERS IN A DISPLAY DEVICE

(75) Inventor: Thomas E. Dowdy, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/625,282

(22) Filed: Jan. 20, 2007

(65) Prior Publication Data

US 2007/0115293 A1 May 24, 2007

Related U.S. Application Data

(63) Continuation of application No. 10/816,556, filed on Apr. 1, 2004, now Pat. No. 7,180,526, which is a continuation of application No. 08/906,648, filed on Aug. 7, 1997, now Pat. No. 6,812,930, which is a continuation of application No. 08/644,535, filed on May 10, 1996, now abandoned.

(51) Int. Cl.
*G09G 5/02* (2006.01)

(52) U.S. Cl. ..... 345/604; 345/539; 345/545; 345/546

(58) Field of Classification Search ..... 345/604, 345/539, 545, 546
See application file for complete search history.

(56) References Cited

U.S. PATENT DOCUMENTS 4,439,762 A 3/1984 Van Vliet et al.
5,241,656 A 8/1993 Loucks et al.
5,388,220 A 2/1995 Okabayashi
5,479,606 A 12/1995 Gray
5,515,494 A 5/1996 Lentz
5,559,954 A 9/1996 Sakoda et al.
5,574,836 A 11/1996 Broemmelsiek
5,608,864 A 3/1997 Bindlish et al.
5,625,386 A 4/1997 Howard et al.
5,680,175 A 10/1997 Yanai et al.
5,914,729 A 6/1999 Lippincott
5,982,399 A * 11/1999 Scully et al. ..... 345/522
6,384,838 B1 * 5/2002 Hannah ..... 345/601
6,812,930 B1 11/2004 Dowdy
7,180,526 B2 2/2007 Dowdy

* cited by examiner

*Primary Examiner*—Matthew C. Bella
*Assistant Examiner*—Mike Rahmjoo
(74) *Attorney, Agent, or Firm*—Sawyer Law Group LLP

(57) ABSTRACT

Methods and systems for transforming data in a system are provided. In one implementation, the method includes providing a first frame buffer, and providing a second frame buffer that is separate from the first frame buffer. The first frame buffer is configured to support a first format compatible with a format associated with an application program interacting with the system, and the second frame buffer is configured to support a second format compatible with a format associated with an output device coupled to the system. The method further includes transforming data provided by the application program from the first format supported by the first frame buffer to the second format supported by the second frame buffer for output on the output device to provide compatibility between the application program and the output device.

18 Claims, 3 Drawing Sheets

METHOD AND APPARATUS FOR TRANSFORMING DISPLAY DATA USING MULTIPLE FRAME BUFFERS IN A DISPLAY DEVICE

CROSS REFERENCE TO RELATED APPLICATIONS

This application is a continuation of application Ser. No. 10/816,556, filed Apr. 1, 2004 now U.S. Pat. No. 7,180,526, which is a continuation of application Ser. No. 08/906,648, filed Aug. 7, 1997 now U.S. Pat. No. 6,812,930, which is a continuation of application Ser. No. 08/644,535, filed on May 10, 1996 now abandoned, the entire contents of which are incorporated by reference herein.

FIELD OF THE INVENTION

The present invention relates to device formats in a computer system, and more particularly to maintaining compatible device formats in device lists for computer systems with expanded device formats.

BACKGROUND OF THE INVENTION

In typical computer systems, application programs submit data in a predefined format for producing desired outputs on display devices. The data is normally stored in a frame buffer in the computer system. As shown in FIG. 1A, a typical system arrangement includes an application program 10 which interacts with and submits data to a computer system 12. The computer system 12 includes a central processing unit (CPU) 14 coupled to a frame buffer 16. The frame buffer 16 is further coupled to a digital-to-analog converter (DAC) 18. The DAC 18 receives digital data from the frame buffer 16 and converts the digital data by well known techniques to analog data for output on a display device 20. Of course, computer system 12 includes other components to perform other operations, the details of which are well known to those skilled in the art.

With the system arrangement as shown in FIG. 1A, the display device 20 may be one of a number of display device types, such as color, black and white, etc. Typically, the application program 10 is configured to support a format of at least one display device type. A device list, which describes the format of a frame buffer, such as the frame buffer 16, normally exists within computer system 12 and provides the display device type for the application program 10.

FIG. 1B is a representation of a device list 11. The device list 11 includes a plurality of data structures 13A-13C, each of the data structures 13A-13C representing a particular device, such as a monitor. Each of the data structures 13A-13C include a plurality of data fields 15A-15C, respectively, that indicate information about the device associated with that data structure 13A-13C. Also within each data structure 13A-13C there is typically a next device field 17 which points to the next data structure, as indicated by the arrows in FIG. 1B, thereby allowing for the linking of the data structures 13A-13C to provide the device list 11.

While the system arrangement as shown in FIG. 1A is adequate for some computer systems, most application programs have difficulty supporting new formats developed to improve performance, since such improvements are typically done well after the application program has been developed. Additionally, attempting to change the application program to support such improvements is time-consuming and costly. Without the ability to communicate with a frame buffer operating in accordance with a new format, the application program is generally rendered ineffective, since the application cannot provide data in that new display format.

BRIEF SUMMARY OF THE INVENTION

With these aspects of the present invention, new formats are readily included in a computer system while maintaining compatibility with applications implementing old formats. The provision of frame buffers for the old formats ensures reception of data from the application programs, while the utilization of frame buffers with the new formats allows improved performance and reduced costs to be achieved. Additionally, the inclusion of frame buffers supporting new formats allows applications that also support the new formats to capably utilize them.

The details of one or more implementations are set forth in the accompanying drawings and the description below. Other features and advantages will be apparent from the description and drawings, and from the claims.

BRIEF DESCRIPTION OF SEVERAL VIEWS OF THE DRAWINGS

Like reference symbols in the various drawings indicate like elements.

DETAILED DESCRIPTION OF THE INVENTION

Implementations of the present invention relates to transparently maintaining compatibility for application programs with computer systems having improved display formats. The following description is presented to enable one of ordinary skill in the art to make and use the invention and is provided in the context of a patent application and its requirements. The present invention is not intended to be limited to the implementations shown but is to be accorded the widest scope consistent with the principles and features described herein.

Figure 1A:
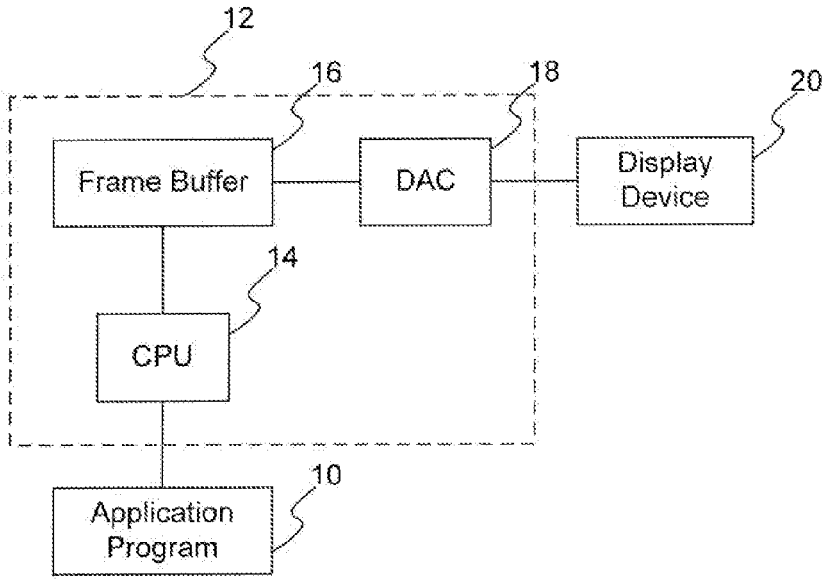
FIG. 1A (Prior Art)
FIG. 1A illustrates a partial block diagram of a typical computer system.
Figure 1B:
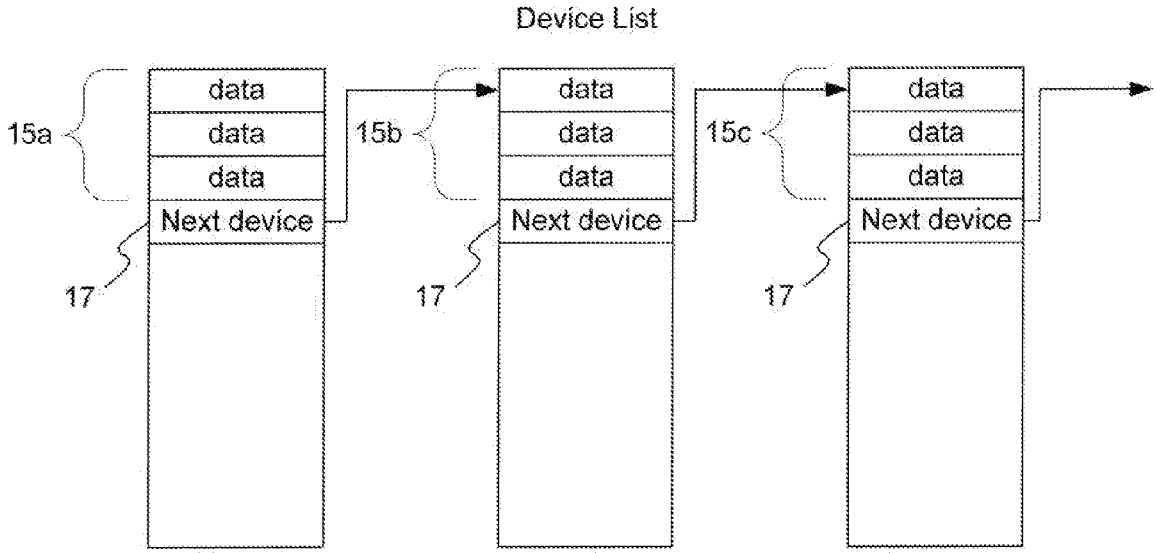
FIG. 1B (Prior Art)
FIG. 1B illustrates a block diagram of a device list in a typical computer system.
Figure 2:
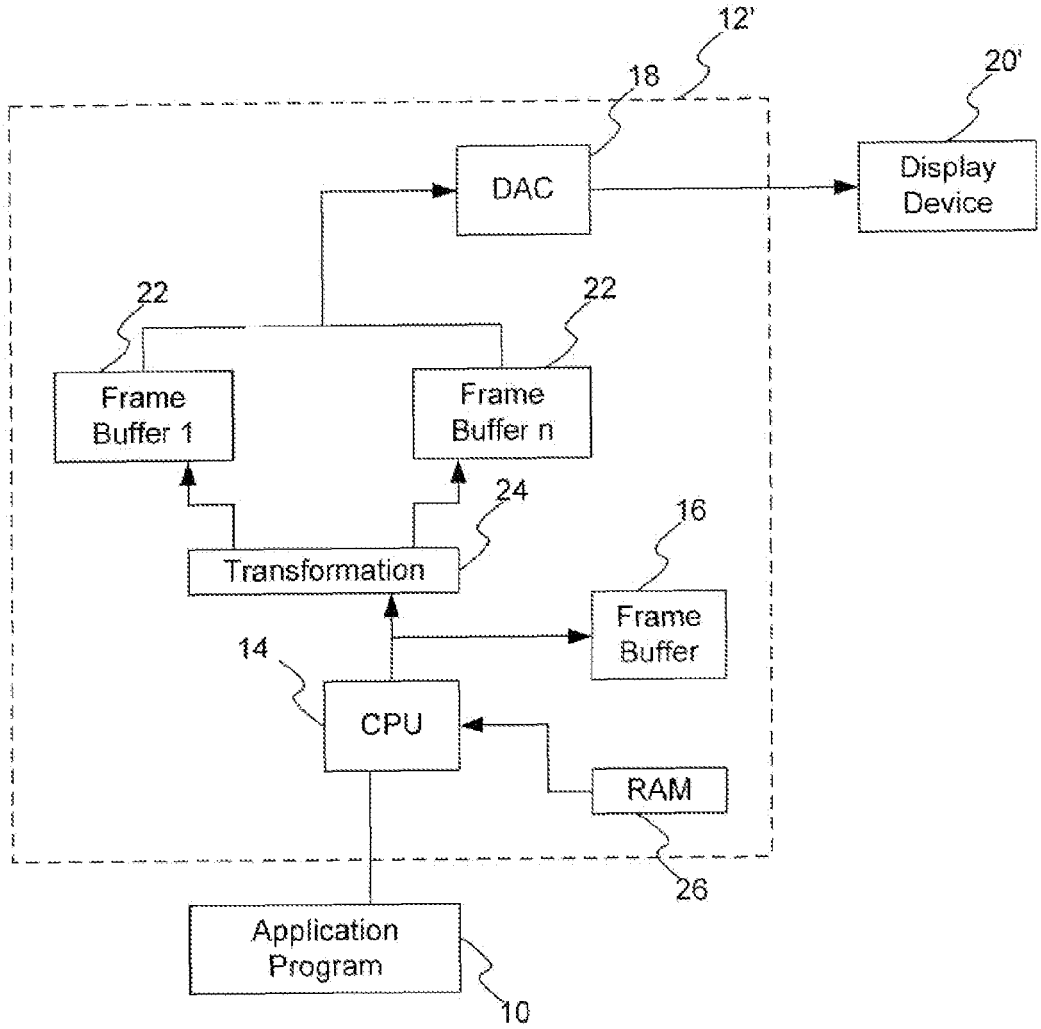
FIG. 2 illustrates a partial block diagram of a computer system in accordance with the present invention.

FIG. 2 presents a system arrangement in accordance with the present invention with like components from FIG. 1 numbered similarly. The system arrangement of FIG. 2 includes an application program 10 running on a computer system 12', such as an Apple Macintosh computer. Computer system 12' includes a CPU 14 and frame buffer 16. In one implementation, the frame buffer 16 supports a known device format that provides compatibility for the device formats supported by the application program 10. Computer system 12' further includes additional frame buffers 22 which represent a chosen number, e.g. 1 to n, of frame buffers supporting differing device formats for display data output on at least one display device 20'. As used herein, device formats preferably refer to a resolution specification (number of dots per inch (dpi)) for a display device 20', a video standard, including but not limited to RGB, YUV, etc., for a display device 20', and/or a depth, e.g. a number of bits per pixel, of data that the frame buffer stores for a given display device 20'. Further included in computer system 12' is transformation mechanism 24. Transformation mechanism 24 is suitably provided as a software mechanism, hardware mechanism, or a combination of both, to appropriately transform data submitted by application program 10 to computer system 12' from a format compatible with the frame buffer 16 to a format compatible with at least one of the frame buffers 22.

Figure 3:
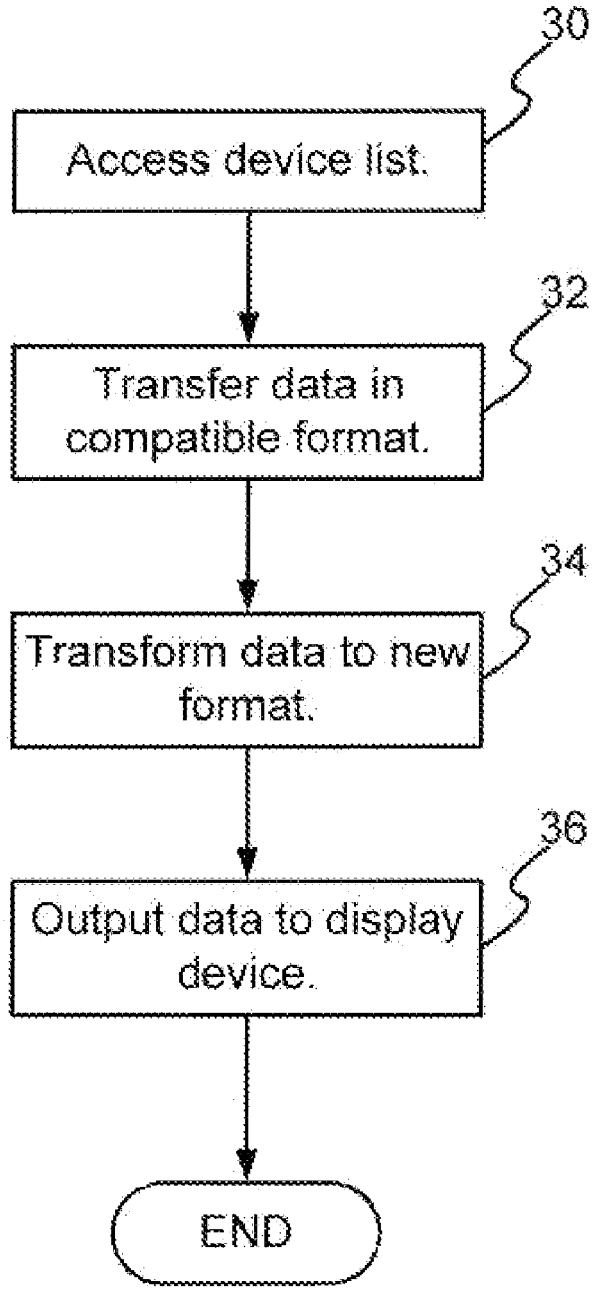
FIG. 3 illustrates a flow diagram of the operation of the system of FIG. 2.

FIG. 3 presents an operation for the components of FIG. 2 including transformation mechanism 24 in accordance with one implementation. The application program 10 suitably accesses a device list from computer system 12' to determine if a compatible display device exists (step 30). By including the frame buffer 16 in the computer system 12', the application program 10 is ensured of recognizing a suitable device in the device list and accessing a compatible frame buffer in the computer system 12' to enable successful data transfer (step 32). In one implementation, the data input to frame buffer 16 is not provided to a display device 20', but is transferred to RAM 26 and is transformed by the transformation mechanism 24.

In accordance with one implementation, the transformation mechanism 24 also receives the data submitted to frame buffer 16 and transforms the data with the necessary format adjustments to one of the frame buffers 22 (step 34). By way of example, one of the frame buffers 22 may provide a new format that supports an increase in the resolution, e.g., from 72 dpi to 144 dpi, for better output on a display device 20. Transformation mechanism 24 suitably doubles the resolution by techniques that are well-known by those skilled in the art. Such a mechanism is described in "Digital Image Warping" by George Wolberg (Wolberg reference) which is published by IEEE Computer Society Press (1990). Alternatively, a frame buffer 22 may support a new format that reduces the number of bits stored per pixel, e.g., from 32 bits per pixel to 24 bits per pixel, with the transformation mechanism 24 eliminating a byte of data to reduce hardware storage requirements, as is well understood by those skilled in the art. Such a mechanism is described in "Computer Graphics Principles and Practices", 2nd edition, by Foley, Van Dam, Feiner and Hughes (Van Dam reference) which is published by Addison-Wesley (1990).

In another new format to increase display options, a frame buffer 22 may support a change to a different video standard, such as from RGB (red-green-blue) standard to YUV standard. Transformation mechanism 24 then suitably performs such changes, for example, using techniques described in the Van Dam reference. Once transformation of the data is completed, the appropriate frame buffer 22 transfers the data from the application program 10 in the proper format for a display device 20' through DAC 14 (step 36).

With the present invention, new formats can be developed to reduce costs and improve performance with transparent compatibility for programs developed to correspond with old formats. The ability to provide both the 'real' frame buffers, i.e., frame buffers 22, that follow the new formats and the 'alternate' frame buffer, i.e., frame buffer 16, that follows the old format in device lists of a computer system readily achieves better system operation without requiring the considerable time and expense of making changes to the application programs. Thus, improved flexibility for supporting a variety of formats developed for differing memory depths, differing resolutions, and differing color formats is realized.

Although the foregoing has been described for a display device environment, the principles of the present invention are readily applicable for other computer system component arrangements. For example, video cards supporting multiple apertures typically treat each aperture as a different mode. The card normally has to be put in the appropriate mode before making use of the aperture. With the use of "real" and "alternate" apertures in accordance with the present invention, the transformation mechanism renders switching between modes unnecessary and allows appropriate selection of a desired aperture to occur seamlessly.

Although the present invention has been described in accordance with the implementations shown, there could be variations to the implementations. For example, depths may include 1 bit, 8 bits, 24 bits, 32 bits, etc. per pixel. Further, although specific examples are provided as to the type of new formats possible, these are merely exemplary not restrictive of the present invention. Thus, the development of additional improvements is readily implemented in accordance with the present invention. Accordingly, many modifications may be made without departing from the scope of the present invention, the scope of which is defined by the following claims.

What is claimed is:

1. A method for transforming data in a system, the method comprising:

providing a first frame buffer, the first frame buffer configured to support a first format compatible with a format associated with an application program interacting with the system;

providing a second frame buffer that is separate from the first frame buffer, the second frame buffer being configured to support a second format compatible with a format associated with an output device coupled to the system; and transforming data provided by the application program from the first format supported by the first frame buffer to the second format supported by the second frame buffer for output on the output device to provide compatibility between the application program and the output device.

2. The method of claim 1, wherein:

the first format comprises a first resolution; and the second format comprises a second resolution that is different from the first resolution.

3. The method of claim 1, wherein:

the first format comprises a first depth of data that the first frame buffer stores for a given output device; and the second format comprises a second depth of data that the second frame buffer stores for a given output device.

4. The method of claim 1, wherein:

the first format comprises a first video standard; and the second format comprises a second video standard that is different from the first video standard.

5. The method of claim 1, wherein the system is a computer system.

6. A computer readable medium containing program instructions, tangibly stored thereon, for:

providing a first frame buffer, the first frame buffer configured to support a first format compatible with a format associated with an application program interacting with the system;

providing a second frame buffer that is separate from the first frame buffer, the second frame buffer being configured to support a second format compatible with a format associated with an output device coupled to the system; and transforming data provided by the application program from the first format supported by the first frame buffer to the second format supported by the second frame buffer for output on the output device to provide compatibility between the application program and the output device.

7. The computer readable medium of claim 6, wherein:

the first format comprises a first resolution; and the second format comprises a second resolution that is different from the first resolution.

8. The computer readable medium of claim 6, wherein:

the first format comprises a first depth of data that the first frame buffer stores for a given output device; and the second format comprises a second depth of data that the second frame buffer stores for a given output device.

9. The computer readable medium of claim 6, wherein:

the first format comprises a first video standard; and the second format comprises a second video standard that is different from the first video standard.

10. The computer readable medium of claim 6, wherein the system is a computer system.

11. A system comprising:

a first frame buffer configured to support a first format compatible with a format associated with an application program interacting with the system;

a second frame buffer that is separate from the first frame buffer, the second frame buffer configured to support a second format compatible with a format associated with an output device coupled to the system; and a transformation mechanism to transform data provided by the application program from the first format supported by the first frame buffer to the second format supported by the second frame buffer for output on the output device to provide compatibility between the application program and the output device.

12. The system of claim 11, wherein:

the first format comprises a first resolution; and the second format comprises a second resolution that is different from the first resolution.

13. The system of claim 11, wherein:

the first format comprises a first depth of data that the first frame buffer stores for a given output device; and the second format comprises a second depth of data that the second frame buffer stores for a given output device.

14. The system of claim 11, wherein:

the first format comprises a first video standard; and the second format comprises a second video standard that is different from the first video standard.

15. The system of claim 11, wherein the transformation mechanism is implemented as a software mechanism running on the r system.

16. The system of claim 11, wherein the transformation mechanism is implemented as a hardware mechanism.

17. The system of claim 11, wherein the transformation mechanism is implemented as a combination of hardware an software running on the system.

18. The system of claim 11, wherein the system is a computer system.

* * * * *